US007779795B2

(12) United States Patent
Warren

(10) Patent No.: US 7,779,795 B2
(45) Date of Patent: Aug. 24, 2010

(54) VALVE SYSTEM FOR OPPOSED PISTON ENGINES

(76) Inventor: James C. Warren, 5409 Galley Ct., Fairfax, VA (US) 22032

( * ) Notice: Subject to any disclaimer, the term of this patent is extended or adjusted under 35 U.S.C. 154(b) by 402 days.

(21) Appl. No.: 12/007,346

(22) Filed: Jan. 9, 2008

(65) Prior Publication Data

US 2009/0173299 A1 Jul. 9, 2009

(51) Int. Cl.
*F01B 7/12* (2006.01)
*F01L 1/00* (2006.01)
*F02N 3/00* (2006.01)

(52) U.S. Cl. ..... 123/51 R; 123/90.1; 123/188.2

(58) Field of Classification Search ..... 123/51 R, 123/51 AA, 51 BA, 51 BB, 51 BC, 51 BD, 123/188.2, 188.4, 188.16, 90.1, 90.2, 90.21, 123/90.39, 90.41, 90.44
See application file for complete search history.

(56) References Cited

U.S. PATENT DOCUMENTS

| | | | | |
|---|---|---|---|---|
| 2,486,185 A | | 10/1949 | Mallory | |
| 3,394,683 A | * | 7/1968 | Erick | 123/51 BA |
| 3,747,574 A | | 7/1973 | Bland | 123/21 |
| 4,164,209 A | | 8/1979 | Grants | 123/188 |
| 4,206,728 A | | 6/1980 | Trenne | 123/90.12 |
| 4,852,532 A | | 8/1989 | Bishop | |
| 4,860,704 A | | 8/1989 | Slaughter | 123/237 |
| 5,241,927 A | | 9/1993 | Rhoads | |
| 5,572,967 A | | 11/1996 | Donaldson, Jr. | |
| 5,655,494 A | | 8/1997 | Donaldson, Jr. | |
| 5,864,948 A | | 2/1999 | Jesel | |
| 5,878,707 A | | 3/1999 | Ballard | |
| 6,006,714 A | | 12/1999 | Griffin et al. | |
| 6,470,841 B2 | | 10/2002 | Takahashi et al. | |
| 6,615,784 B2 | | 9/2003 | Faria et al. | |
| 6,732,692 B1 | | 5/2004 | Cetnar et al. | |

* cited by examiner

*Primary Examiner*—Noah Kamen
(74) *Attorney, Agent, or Firm*—L.C. Begin & Associates

(57) ABSTRACT

The valve system for opposed piston engines essentially comprises a single poppet valve opening into the common combustion chamber between the two opposed pistons of each piston and cylinder pair. The engine for which the mechanism is adapted includes a rotating internal cylinder surrounding each piston pair, with a stationary outer cylinder or case surrounding the rotating cylinder. The valve is pivotally attached at one side or end thereof to the edge of the valve port of the rotating cylinder, and is actuated by an arm or arms having guides (rollers, etc.) at the distal end(s) thereof, which are captured in corresponding cam track(s) or channel(s) formed in the fixed outer cylinder or case of the engine. The cam track has a variable radius, with the valve arm(s) and guide(s) alternately lifting and lowering as the guide(s) travel (s) in the variable radius cam track(s), thereby closing and opening the valve.

20 Claims, 13 Drawing Sheets

VALVE SYSTEM FOR OPPOSED PISTON ENGINES

BACKGROUND OF THE INVENTION

1. Field of the Invention

The present invention relates generally to reciprocating internal combustion engines. More specifically, the present invention is a poppet valve system for an opposed piston engine configuration, in which each piston pair shares a common combustion chamber and operates two mutually opposed crankshafts.

2. Description of the Related Art

The concept of the opposed piston engine, i.e., an engine configuration in which the two pistons of each piston pair drive mutually opposed crankshafts disposed to the outboard sides of the engine with the two pistons having facing crowns defining a single combustion chamber therebetween, has been known for some time. A problem with such engines is the provision of suitable valving for the introduction of intake charges and the disposal of the exhaust gases from the combustion chamber. As this type of engine has no cylinder head per se, it is not possible to place poppet type valves in the cylinder head as is done conventionally in the vast majority of reciprocating internal combustion engines.

Accordingly, numerous variations on piston port, sleeve valve, and other valve principles have been applied to such opposed piston engines. Many of these principles are not adaptable to the Otto cycle, i.e., four-stroke cycle, spark ignition reciprocating internal combustion engine. Those valve principles that have been adapted for use with Otto cycle opposed piston engines have generally suffered certain inefficiencies due to the valve configuration. The conventional poppet type valve as used in the overwhelming majority of reciprocating internal combustion engines, has found such widespread use primarily due to the efficiencies provided by this type of valve mechanism.

Thus, a valve system for opposed piston engines solving the aforementioned problems is desired.

SUMMARY OF THE INVENTION

The valve system for opposed piston engines essentially comprises a single poppet type valve opening into the common combustion chamber between the two opposed pistons of each piston and cylinder pair. The engine configuration to which the present poppet valve mechanism is adapted includes a rotating internal cylinder surrounding each piston pair, with a stationary outer cylinder or case surrounding the rotating cylinder. The valve is pivotally attached at one side or end thereof to the edge of the valve port of the rotating cylinder surrounding the pistons, and is actuated by an arm or arms having guides (rollers, etc.) at the distal end(s) thereof, which are captured in corresponding cam track(s) or channel (s) formed in the fixed outer cylinder or case of the engine.

The engine and valve system operate by gearing or otherwise driving the rotation of the inner cylinders to correspond with the reciprocation of the pistons of each pair. The inner cylinder includes a single valve port extending about a portion of the circumferential periphery thereof, with a single valve disposed across or over the port. As the inner cylinder rotates, it carries the single valve along with it and periodically aligns the cylinder port and valve with a stationary intake port and separate exhaust port in the engine case, with the intake port being arcuately separated from the intake port. The cam track (s) vary in height or radial distance from the center of the cylinder in their path(s) about the cylinder. As the valve guide (s) travel in the variable radius cam track(s), the valve is periodically lifted away from the center of the cylinder to close over the valve port of the rotating inner cylinder and alternately pushed inwardly toward the center of the cylinder to open the valve port. The opening of the valve port is mechanically coordinated with the passage of the valve port across the intake and exhaust ports provided through the stationary outer cylinder or case wall, thus allowing inflow of intake charges and outflow of exhaust gases from the combustion chamber.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a poppet valve mechanism configured for use with an opposed piston internal combustion engine, i.e. an engine having a single central combustion chamber between the opposed pistons of each piston pair, with each piston of the piston pair driving a separate crankshaft. A single valve port is provided medially in the single cylinder of each piston pair, i.e., at the combustion chamber defined by the cylinder and its two opposed pistons, with the cylinder rotating to align the valve port periodically with a separate intake and exhaust passage through the stationary case of the engine. The valve mechanism of the present invention periodically opens and closes the hinged poppet valve in the valve port of the cylinder as the valve port aligns with the intake and exhaust passages of the engine case, to allow the fuel and air mixture (or air only, if direct fuel injection is provided) to enter the combustion chamber and exhaust gases to be expelled from the combustion chamber.

Figure 1:
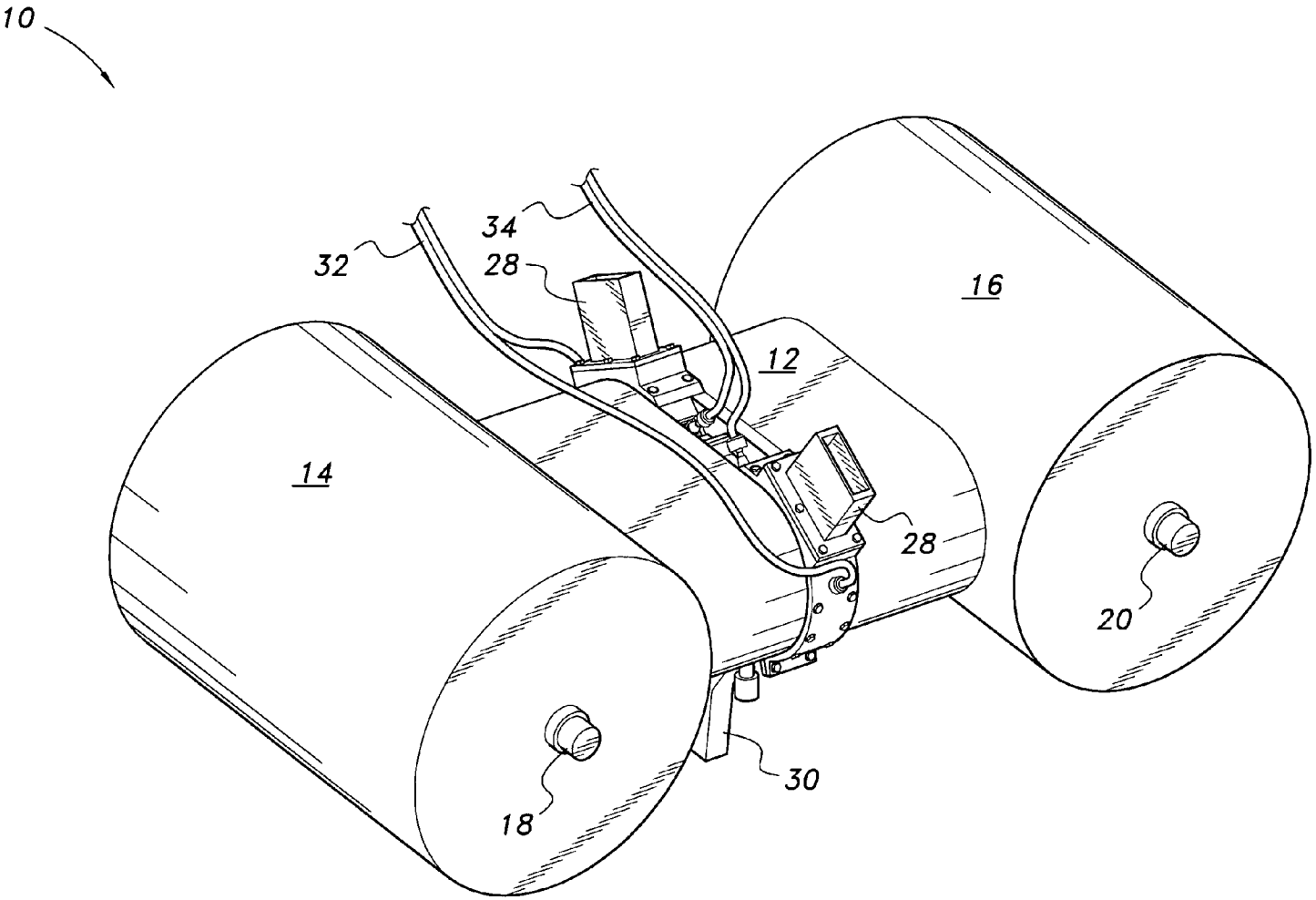
FIG. 1 is an external perspective view of a four cylinder opposed piston engine incorporating the valve system of the present invention, showing its general configuration.

FIG. 1 of the drawings is a perspective view of an exemplary opposed piston engine 10 to which the present valve mechanism may be applied. The engine 10 includes a stationary engine cylinder case 12 having two mutually opposed crankcases 14 and 16, with each crankcase having a crankshaft, respectively 18 and 20 installed therein. The noses of these two crankshafts are shown in FIG. 1 of the drawings, with the complete second crankshaft 20 being shown in the partial section inverted perspective view of FIG. 2. The cylinder case portion 12 of the engine 10 encloses the rotary cylinders and opposed pistons of the assembly, generally as shown in FIGS. 2, 3, 5, and 6A through 6H.

Figure 2:
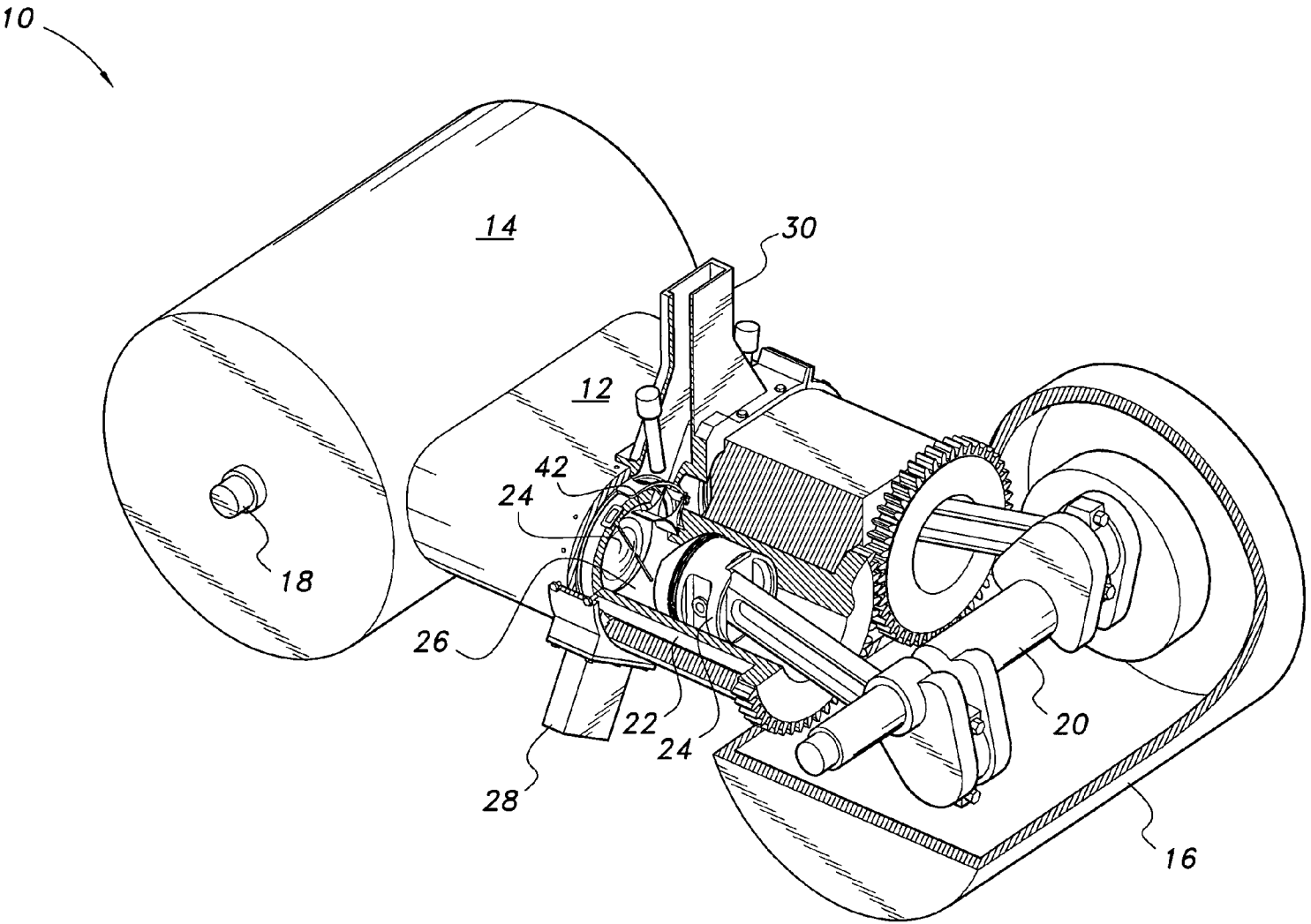
FIG. 2 is an inverted perspective view in partial section of the opposed piston engine of FIG. 1, showing the general location and configuration of the present valve system in one cylinder pair thereof.
Figure 3:
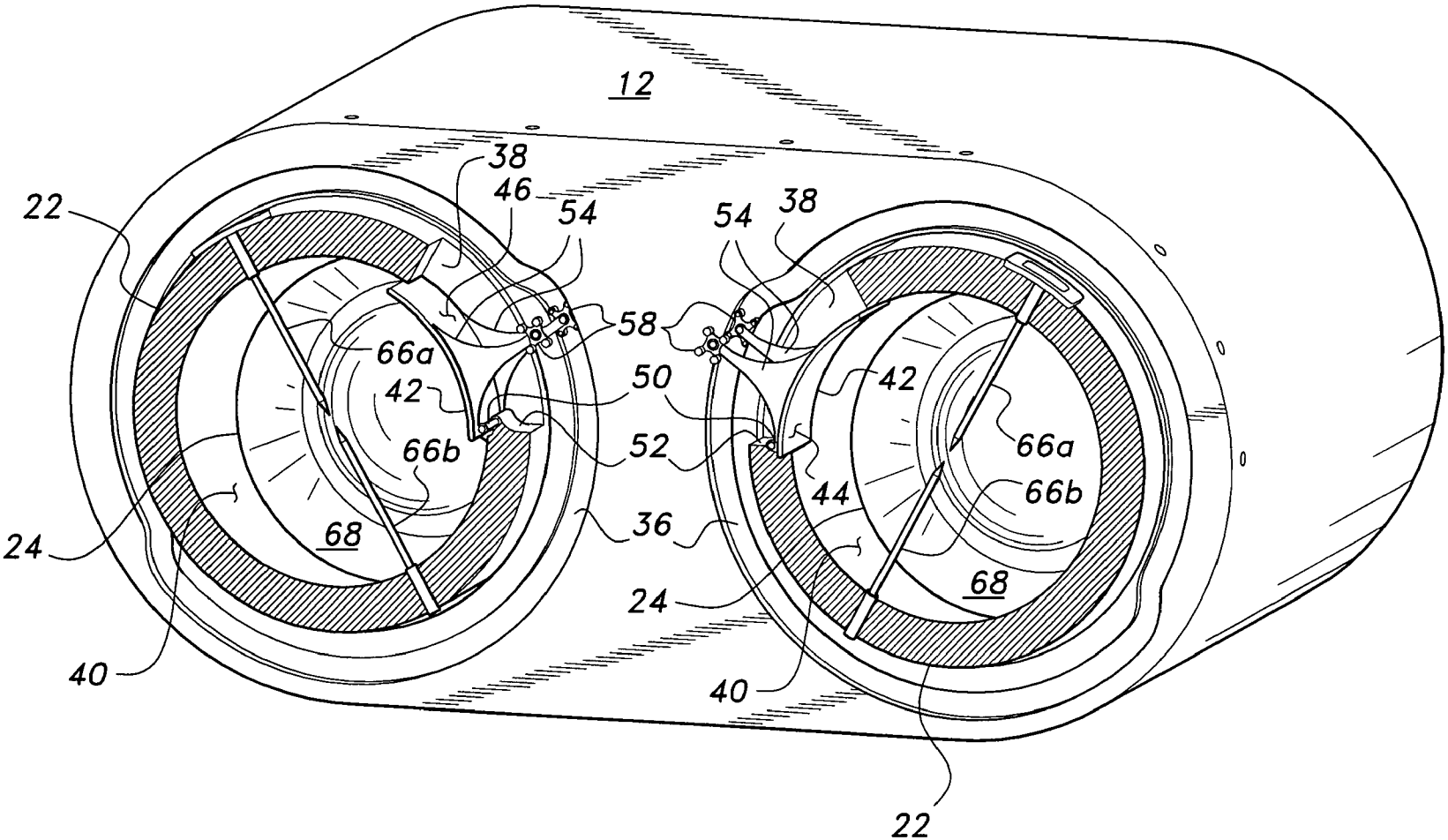
FIG. 3 is a perspective view in section through the central combustion chambers of the opposed piston engine, illustrating further details of the valve system.

The exemplary engine 10 of FIGS. 1 through 3 includes two pairs of opposed pistons, i.e., four pistons in two cylinders, but it will be seen that any practicable number N of cylinders with 2N pistons may be used to form various embodiments of such an opposed piston engine. FIG. 2 of the drawings shows at least a portion of both opposed pistons 24 within one of the cylinders 22, with the cylinder 22 and its two opposed pistons 24 defining a central combustion chamber 26 therebetween. The engine in this drawing has been inverted in order to show the left portion of the cylinder 22 and its left piston 24 without the otherwise obscuring intake port. However, FIGS. 4 through 6H illustrate a portion of only a single cylinder case 12 with a single rotary cylinder 22 and only a single piston 24 shown therein, in order to simplify the illustrated mechanism and clarify the valve mechanism of the present invention. The cylinder case 12 includes circumferentially or angularly spaced intake and exhaust ports, respectively 28 and 30, which deliver the fuel-air mixture (or air, in the case of direct fuel injection) to the cylinder(s) 22 and duct the spent exhaust gases from the cylinder(s). Exemplary ignition leads 32 and fuel injection lines 34 are also shown in FIG. 1. Various other conventional componentry of an internal combustion engine, e.g., cooling system, mechanical fasteners, etc., are not shown in the drawings in order to provide greater clarity for the inventive features shown therein.

Figure 4:
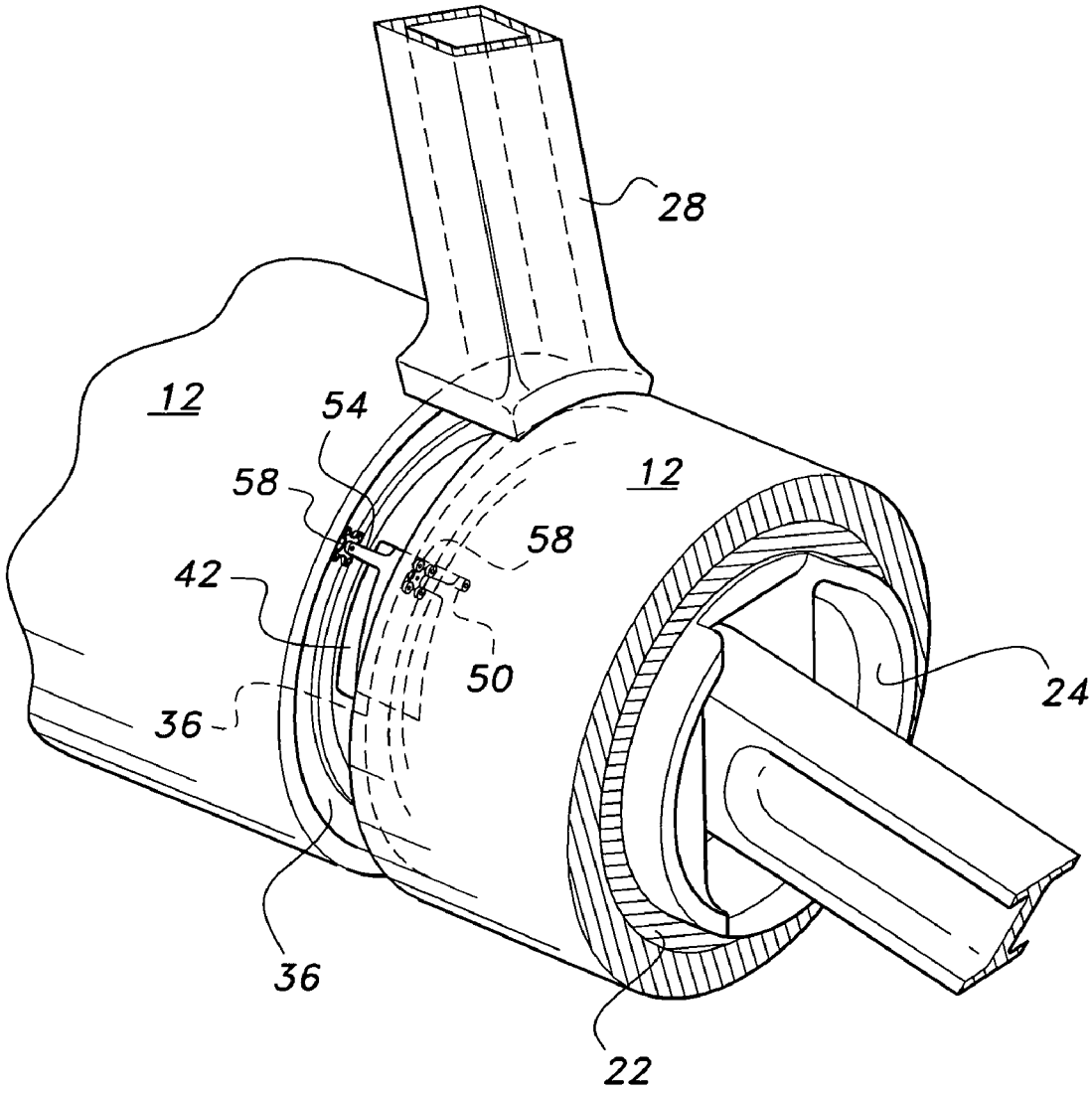
FIG. 4 is a broken away perspective view of the center of a single cylinder assembly of an opposed piston engine, providing further details of the valve mechanism.
Figure 5:
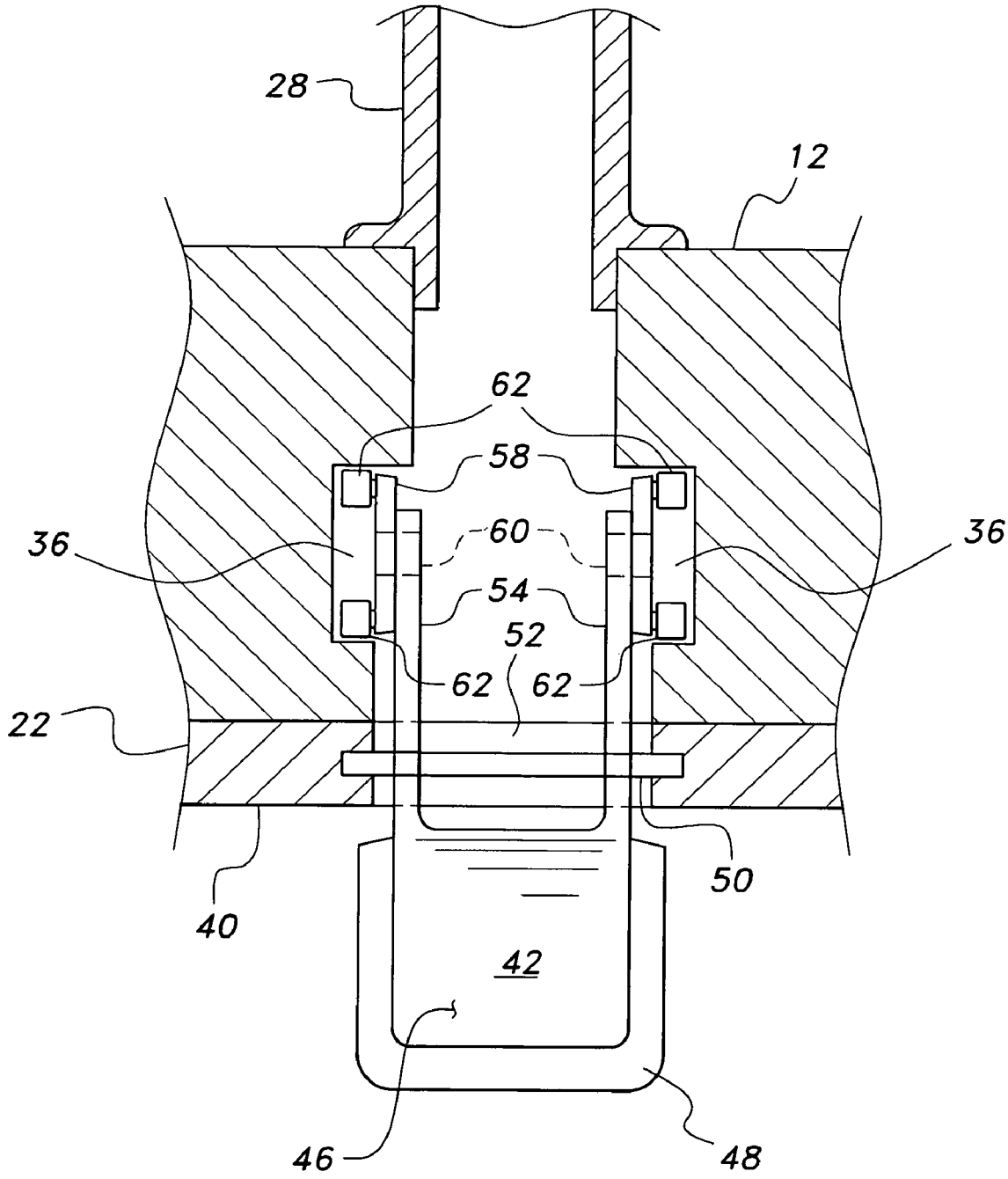
FIG. 5 is an elevation view in section through the central cylinder wall forming one side of the combustion chamber of the engine, showing further details of the valve assembly.

FIGS. 3 through 5 of the drawings illustrate the basic valve mechanism of the present invention. The stationary outer engine or cylinder case 12 includes two medially disposed and mutually opposed circumferential cam channels 36 formed therein and surrounding the corresponding rotary cylinder 22 within the engine cylinder case 12, as shown in FIGS. 4 and 5 of the drawings. The cam channels 36 have variable radii in order to actuate the valve mechanism during rotation of the cylinder 22, as described in detail further below. It will be seen that a single cam channel could be provided, but the corresponding single cam follower and single actuation arm for the valve would result in asymmetric actuation forces on the valve and valve train. Thus, a symmetrical valve actuation system of two opposed cam channels 36 and corresponding symmetrically opposed linkages between the cam channels and the valve, is preferred.

Each cylinder 22 includes a single, medially disposed valve port 38 extending outwardly therethrough from the combustion chamber 26 and internal wall 40 thereof, with a poppet valve 42 installed in the port 38. The poppet valve 42 essentially comprises a curved plate having a combustion chamber face 44 with a curvature closely conforming to the curvature of the internal cylinder wall 40. The valve 42 further includes a back 46 opposite the face 44, and a sealing periphery 48. A valve attachment hinge 50 connects one edge of the valve periphery 48 to the internal wall 52 of the valve port 38, adjacent the internal wall 40 of the cylinder 22.

At least one, and preferably two, actuating arms 54 extend from the back 46 of the valve, with the two actuating arms being directly opposite one another and extending outwardly adjacent to opposite sides of the valve port 38. Each of the actuating arms 54 terminates in a distal end 56 having a cam follower mechanism 58 extending therefrom and riding in the corresponding cam channel 36 of the engine cylinder case 12. The cam follower mechanism is preferably resiliently attached to the distal end 56 of the actuating arm 54 by a resilient bushing connector 60 or the like that permits limited relative movement between the cam follower mechanism 58 and the actuating arm 54. This provides allowance for any small tolerance buildups or dimensional changes due to thermal expansion as the engine 10 is operated. The cam follower mechanism includes at least one cam channel roller 62 extending therefrom and riding within the corresponding cam channel 36. Preferably, the cam follower mechanism 58 is in the form of a "spider" having a series of radially extending arms, with each of the arms having a separate roller 62 extending therefrom. The rollers 62 comprise small roller bearings that ride against the corresponding inner and outer surfaces of the cam channels 36. As the radius of the cam channels 36 vary around the cylinder 22, the rollers 62 are forced radially inwardly and outwardly, thereby driving their attached cam follower mechanisms 58 and valve actuating arms 54 inwardly and outwardly to open and close the valve 42.

FIGS. 6A through 6H illustrate the sequence of valve operation through essentially one clockwise revolution of the cylinder 22 within the stationary outer cylinder case 12. The variable radius cam channel 36 includes a larger radius valve closed portion 36*a*, a decreasing radius ramp portion 36*b* causing the valve to move from a closed to an open position, a relatively smaller radius valve open portion 36*c*, and an increasing radius ramp portion 36*d* which causes the valve to move from its open position to its closed position along the larger radius channel portion 36*a*.

It will be seen that the various portions 36*a* through 36*d* of the cam channel 36 remain in the same relative positions throughout FIGS. 6A through 6H, as the cam channel 36 is formed in the stationary cylinder case 12. However, the cylinder 22 rotates within the cylinder case 12 and carries the valve 42, its actuating arms 54, and the actuating mechanism 58 around the stationary cylinder case 12 as the engine operates, thereby causing the valve actuating mechanism 58 to travel around the circumference of the cam channel 36. As the radius of the cam channel 36 varies, so does the distance between the valve actuating mechanism 58 and the center of the cylinder 22 as the cylinder rotates. Since one edge of the valve 42 is fixed at a constant radius from the center of the cylinder 22 due to the valve attachment hinge mechanism 50, it will be seen that the valve 42 is forced to open toward the center of the cylinder 22 as the actuating mechanism 58 reaches the smaller radius portion 36*c* of the cam channel 36.

Figure 6A:
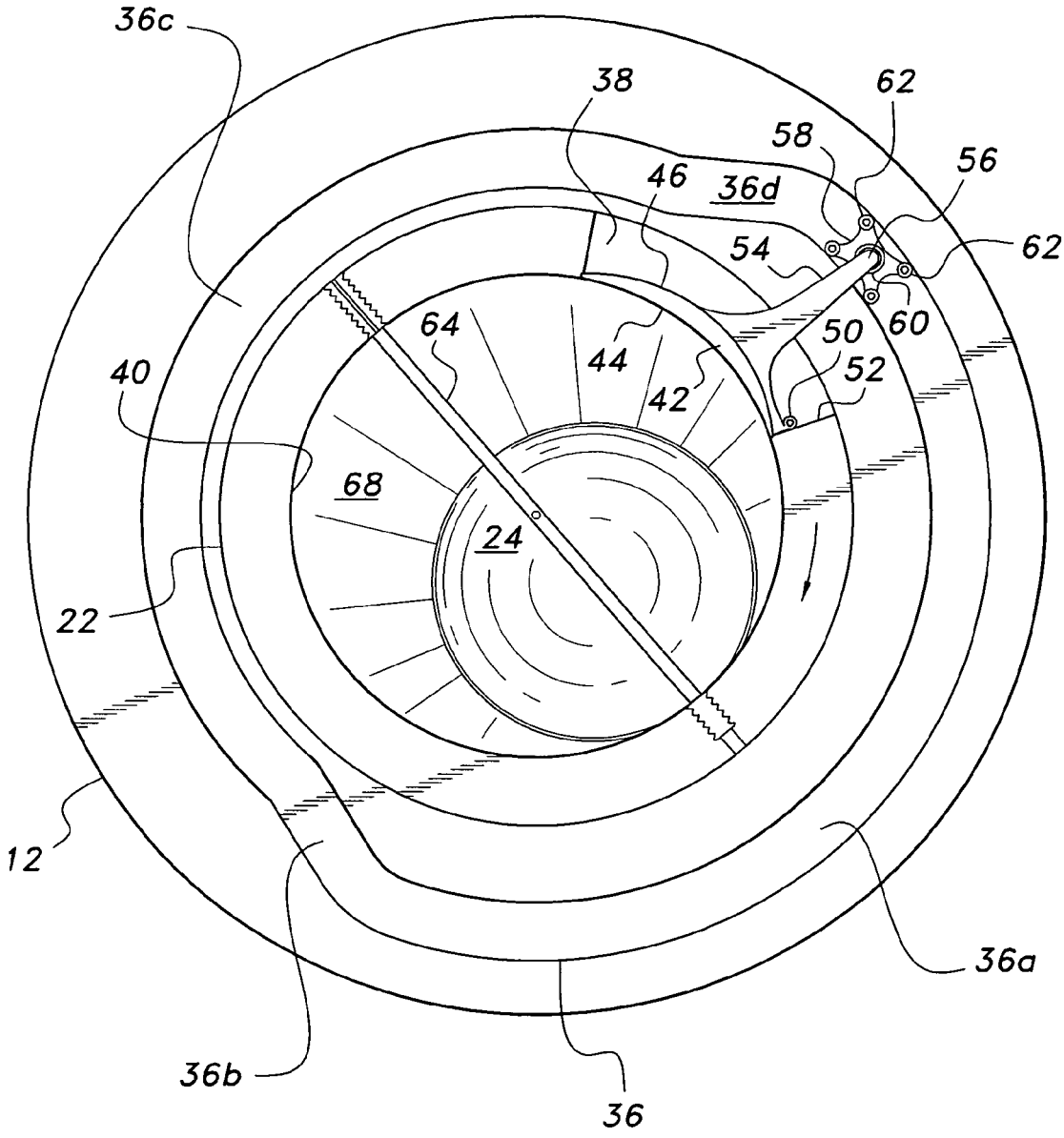
FIGS. 6A through 6H are a series of progressive plan views across a single combustion chamber of the engine, showing the travel and actuation of the valve as the inner cylinder rotates in a clockwise direction within the stationary outer cylinder and valve actuating cam track or channel.

In FIG. 6A, the cam channel follower or valve actuating mechanism 58 has just completed its passage through the increasing radius portion 36*d* of the cam channel, and is shown beginning its travel along the larger radius cam channel portion 36*a*. The greater radius of the cam channel portion 36*a* draws the valve actuating mechanism 58 outwardly from the center of the cylinder 22, thereby closing the valve 42 against the opening of the valve port 38 formed through the wall of the cylinder 22. At this time, the piston 24 is also rising in the cylinder 22 in the compression stroke, i.e., moving outwardly from the drawing sheet toward the viewer in a hypothetical three dimensional version of FIG. 6A.

Figure 6B:
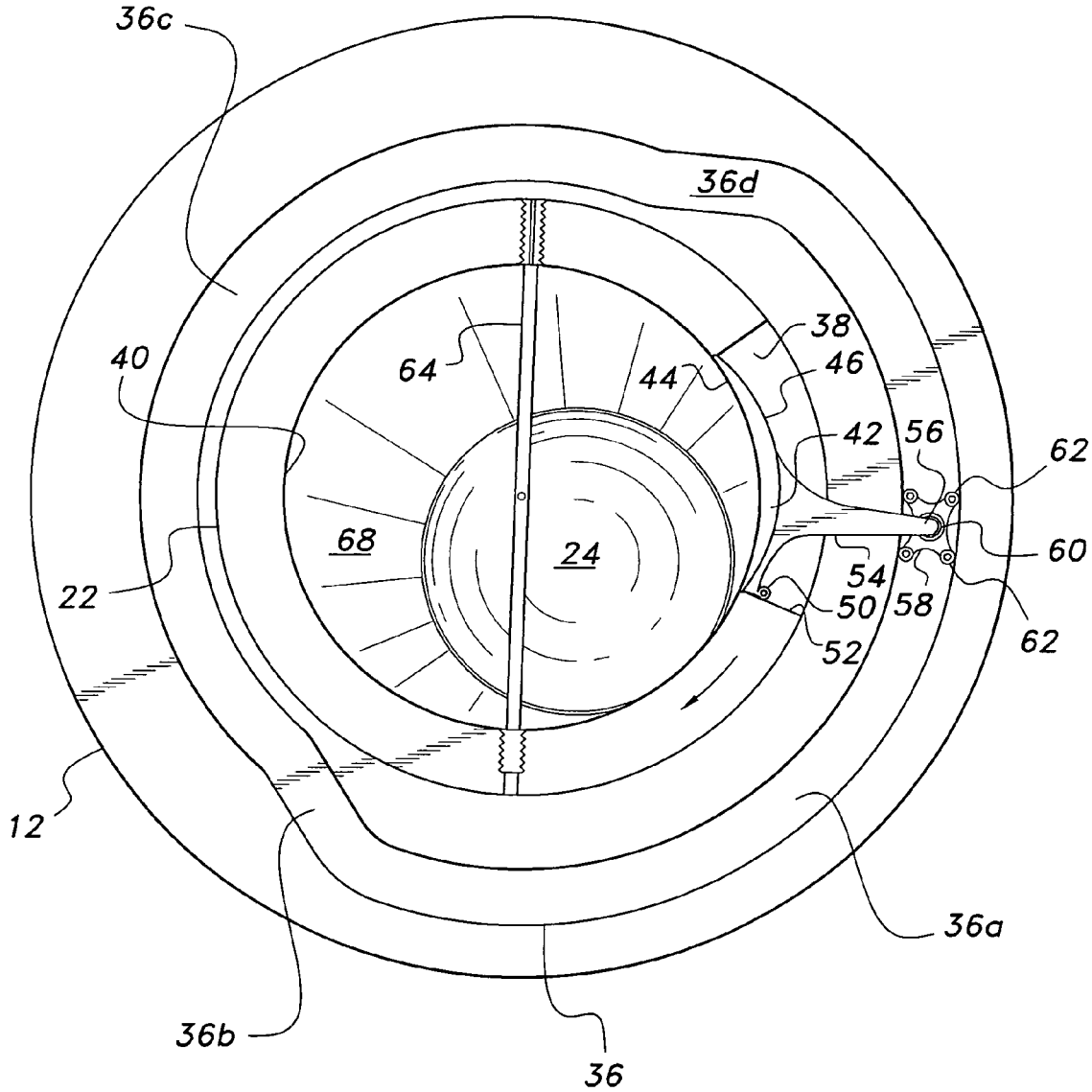

In FIG. 6B, the cylinder 22 has rotated about another forty-five degrees clockwise within the stationary cylinder or engine case 12, to a point just short of midway between the increasing radius, valve closing portion 36*d* and the decreasing radius, valve opening portion 36*b* of the cam channel 36. The piston 24 has continued to rise in the cylinder 22, and is just short of top dead center in FIG. 6B. Due to conventional ignition timing advance, this is approximately the point at which the ignition system would trigger an ignition spark within the combustion chamber defined by the two pistons 24 and the cylinder 22. The opposed piston engine 10 of the present invention utilizes a transverse spark rod 64 that extends across the combustion chamber, and rotates with the cylinder 22. Essentially, a brush or shoe (not shown) disposed at a predetermined point in the wall of the engine cylinder case 12 provides electrical energy to the spark rod 64, with the electrical energy being grounded through the connection of the opposite end of the spark rod with the cylinder 22 and the metal-to-metal contact of the cylinder 22 with various other components of the engine 10. The ignition device may comprise a spark rod 64 with a small passage disposed at the spark gap therein, essentially as shown in FIGS. 6A through 6H, or alternatively a pair of opposed electrodes 66*a* and 66*b* defining an open spark gap therebetween, as shown in FIG. 3 of the drawings.

Figure 6C:
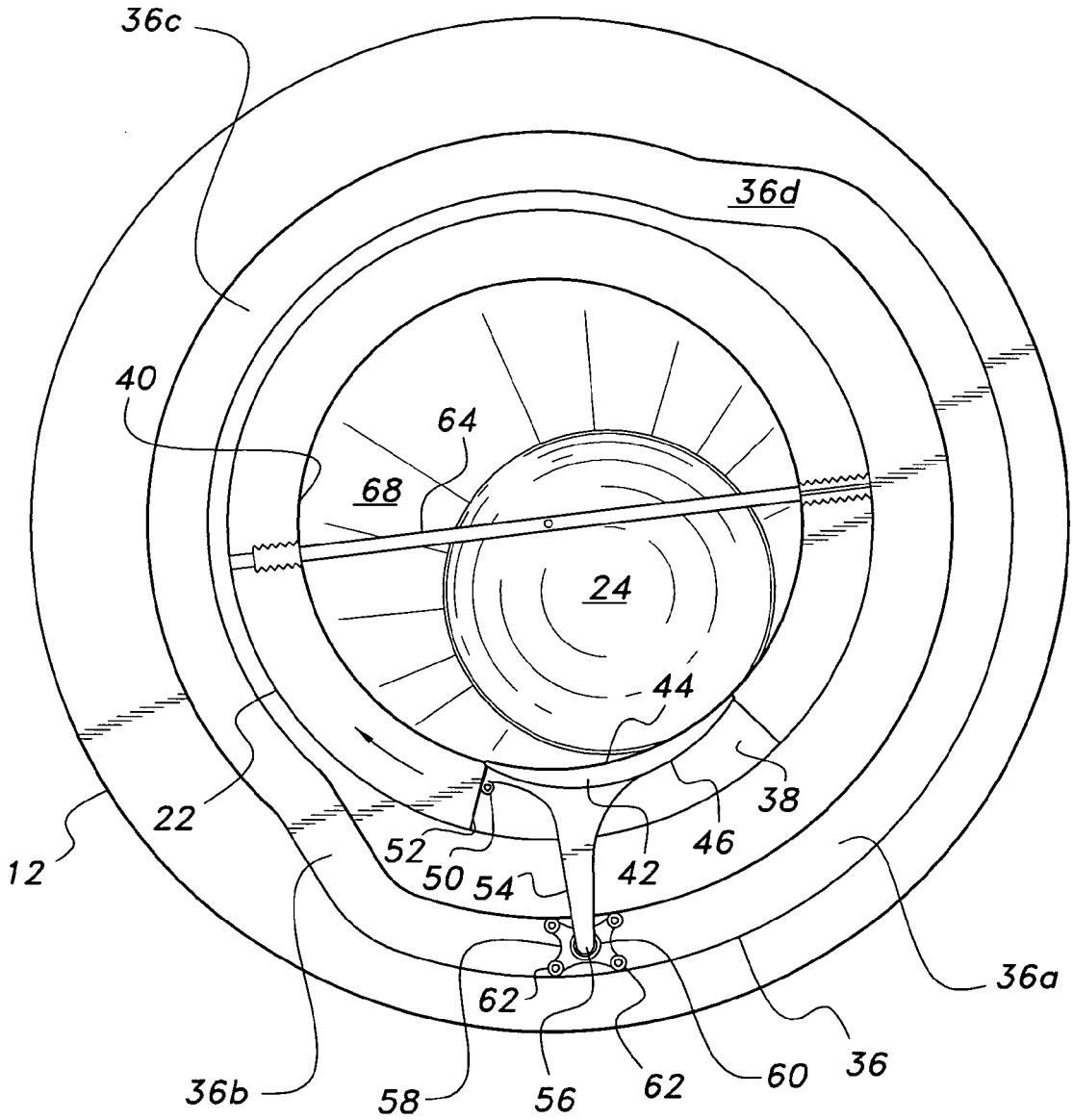

In FIG. 6C, the cylinder 22 has revolved nearly another ninety degrees clockwise from its position shown in FIG. 6B. At this point, the piston 24 is being pushed downwardly within the rotating cylinder 22 due to the expanding gases ignited by the ignition system at the onset of the power stroke. The cam channel follower mechanism 58 continues to be carried along the circumferential cam channel 36 due to the rotation of the cylinder 22 and its valve 42 and actuation arm 54 with its follower or valve actuation mechanism 58 extending therefrom.

Figure 6D:
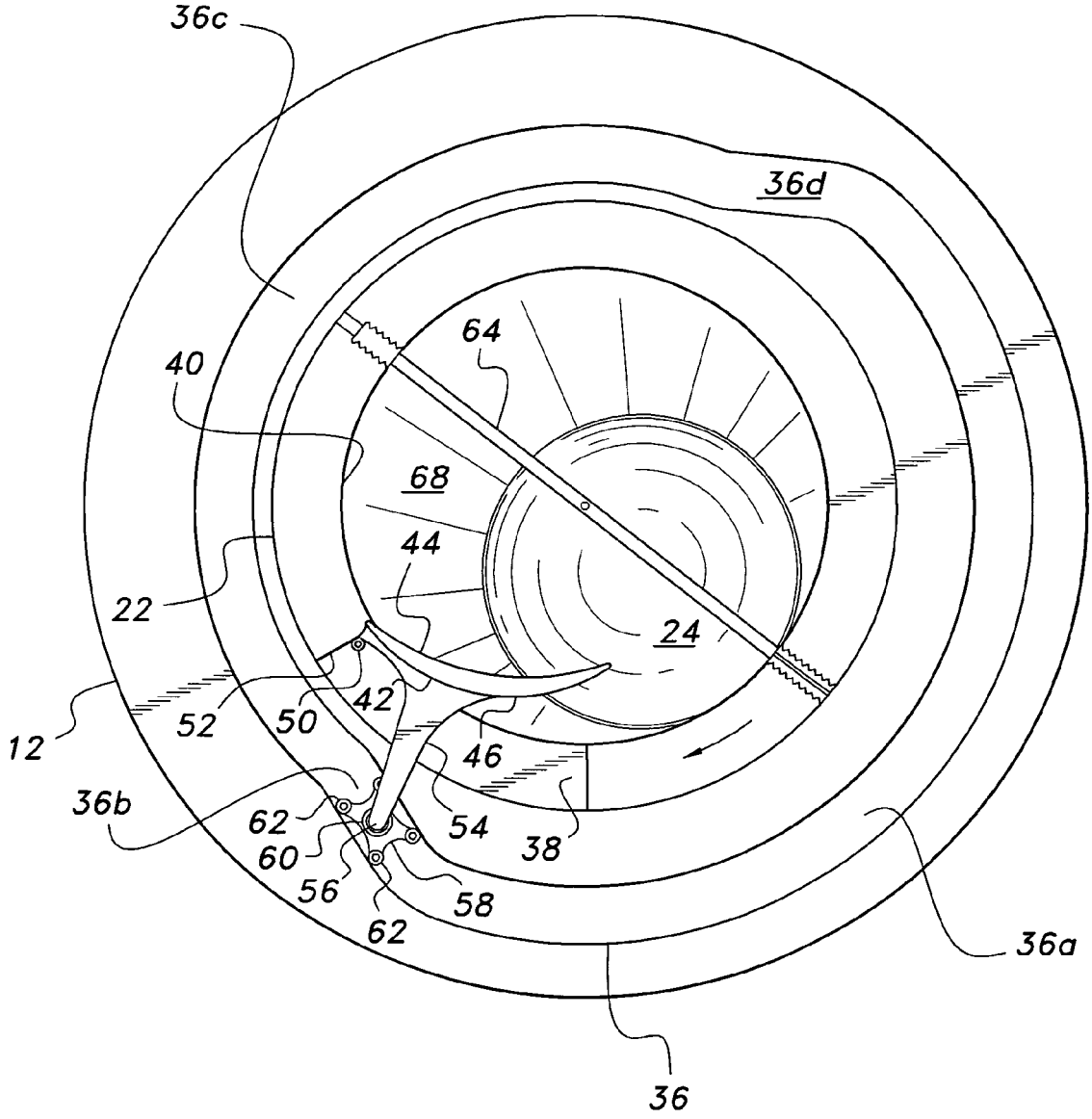

In FIG. 6D, the cylinder 22 has rotated to a point where the valve actuation or cam follower mechanism 58 is being drawn through the decreasing radius portion 36*b* of the cam channel 36. This results in the mechanism 58 and its arm 54 being pushed inwardly toward the center of the cylinder 22, with the arm 54 pushing the valve 44 open into the combustion chamber. The piston 24 is close to the bottom of its stroke at this point, with practically all of the energy of the power stroke having been absorbed. The valve opening at this point is coordinated with the valve port 38 aligned with the exhaust port 30 (not shown in FIGS. 6A through 6H, but shown in other Figs.) to allow the spent exhaust to pass from the combustion chamber.

Figure 6E:
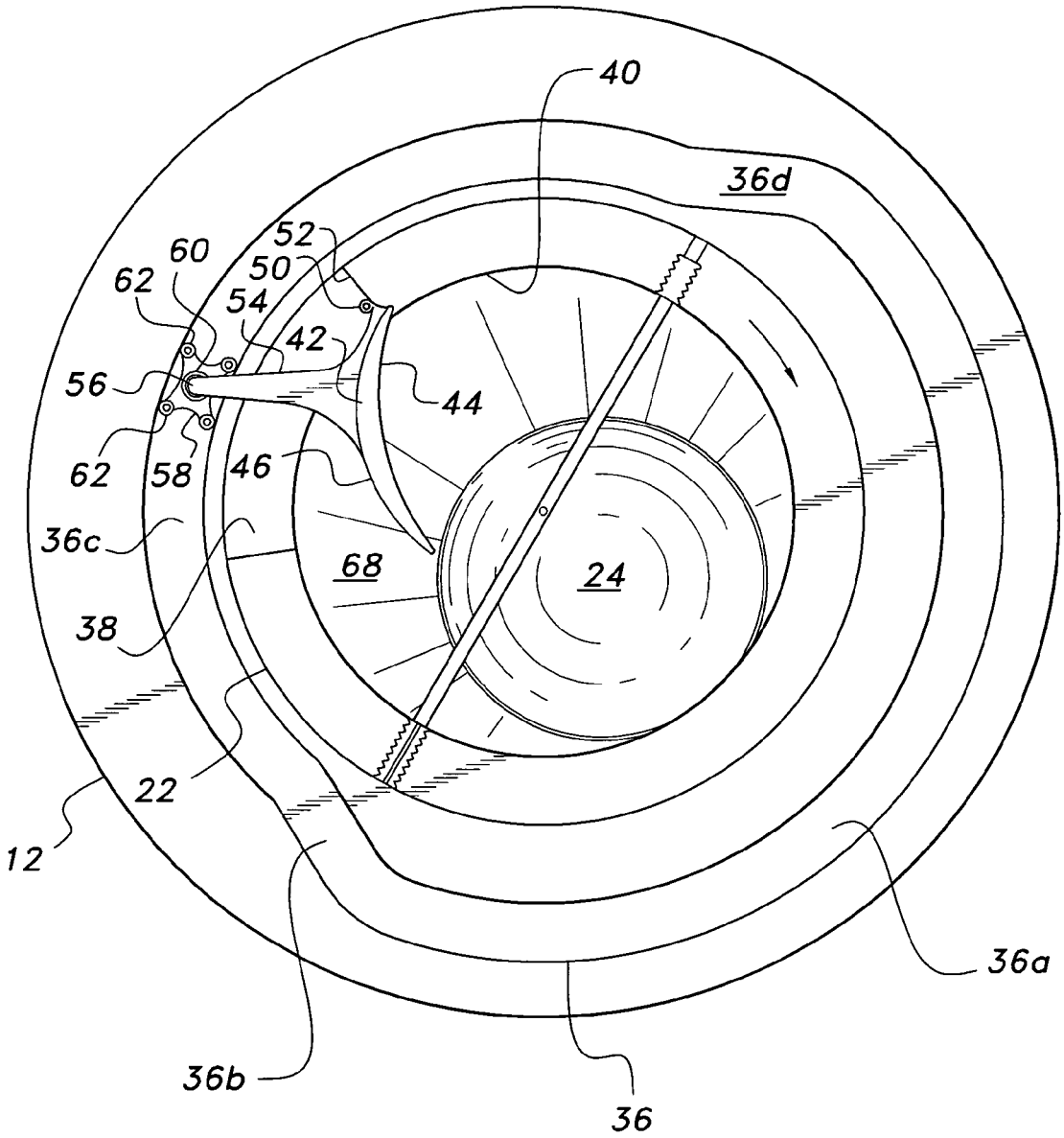

In FIG. 6E the cylinder 22 has rotated about another ninety degrees clockwise from the position shown in FIG. 6D, with the valve actuation or cam follower mechanism 58 passing through the smaller radius portion 36*c* of the cam channel 36. The valve 44 is thus at its greatest opening width into the combustion chamber, as the cam follower mechanism traverses this smallest radius portion of the cam channel. This allows essentially complete expulsion of the exhaust gases from the combustion chamber. At this point, the piston 24 is close to the upper end of its stroke, and the cylinder 22 has rotated to begin to align its valve port 38 with the intake passage 28 (FIGS. 1, 2, 4, and 5) through the stationary case 12 of the engine. It will be noted that the smaller radius portion 36*c* of the cam track extends continuously through the exhaust and intake strokes of the engine, as the alignment of the single valve passage 38 in the rotating cylinder 22 is coordinated with the exhaust and intake passages 28 and 30 of the cylinder case 12 during this portion of the cycle. The piston 24 includes a relief area 68 formed in its crown to provide clearance for the open valve 44 when the piston 24 is at or near its top dead center position at the end of its exhaust stroke and beginning of its intake stroke, as in FIG. 6E.

Figure 6F:
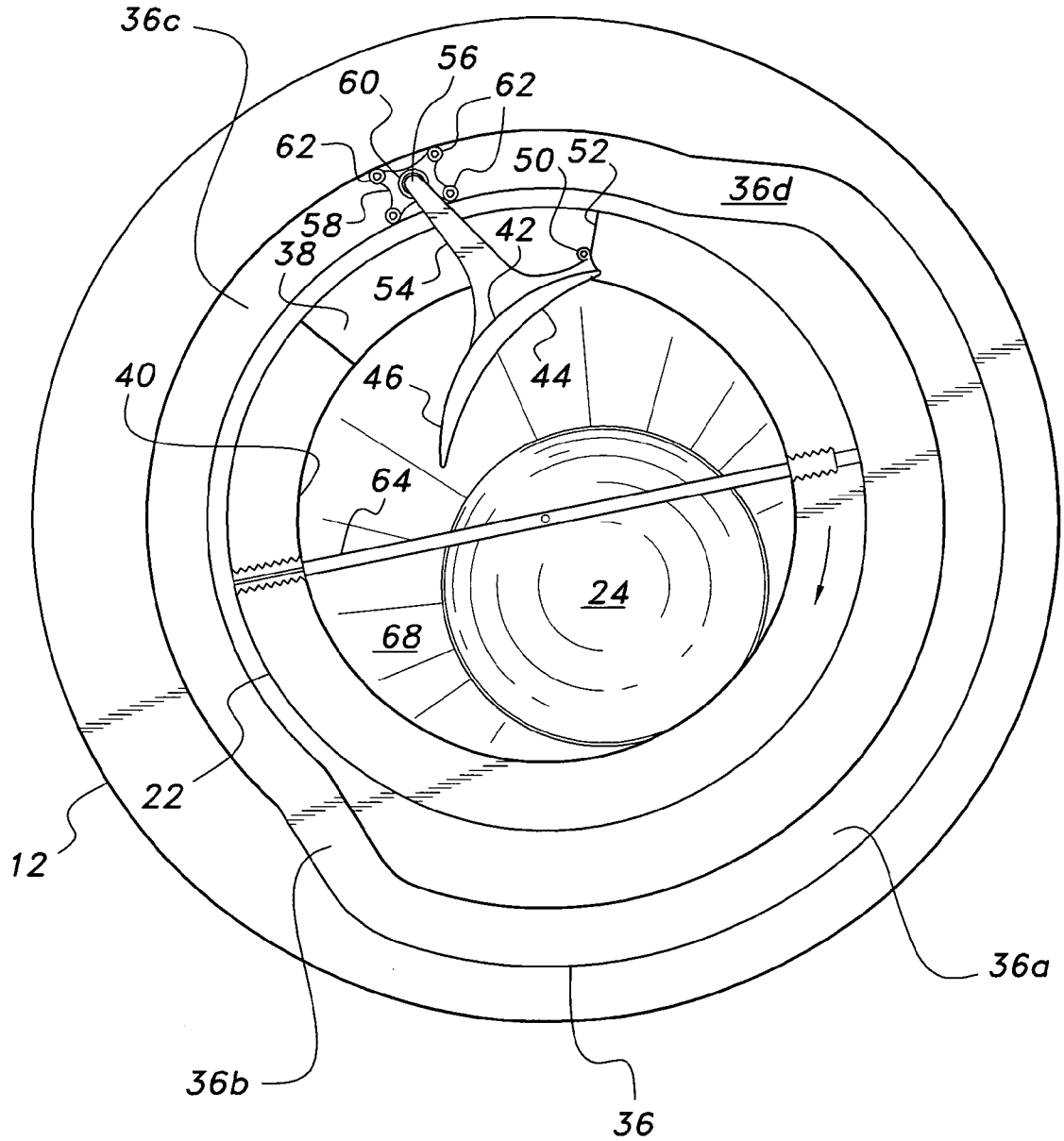

The cylinder 24 has rotated approximately another thirty to forty degrees clockwise in FIG. 6F, from its orientation in FIG. 6E. At this point, the piston 24 is approaching its bottom dead center position at the end of the intake stroke, and the valve actuation or cam follower mechanism 58 is approaching the increasing radius ramp portion 36*d* of the cam channel 36. However, the mechanism 58 is still passing through the smaller radius portion 36*c* of the cam channel 36 in FIG. 6F, so the valve 44 remains fully open.

Figure 6G:
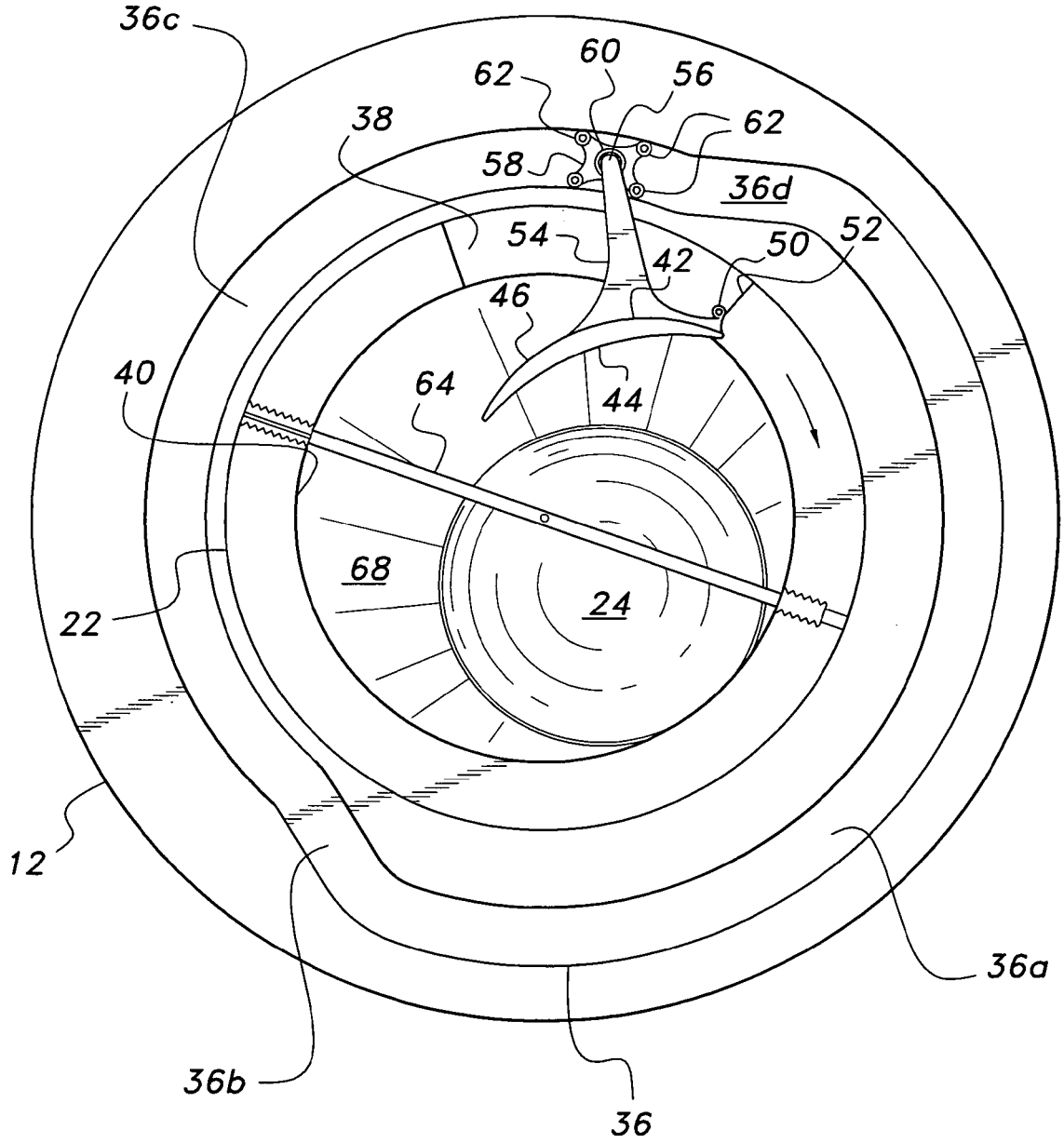

In FIG. 6G, the cylinder 22 has rotated further clockwise to a point where the actuation or cam follower mechanism 58 is just short of the increasing radius ramp portion 36*d* of the cam channel 36. The valve 44 is still fully open at this point to draw in the last of the intake charge, but the piston 24 is very near its bottom dead center position.

Figure 6H:
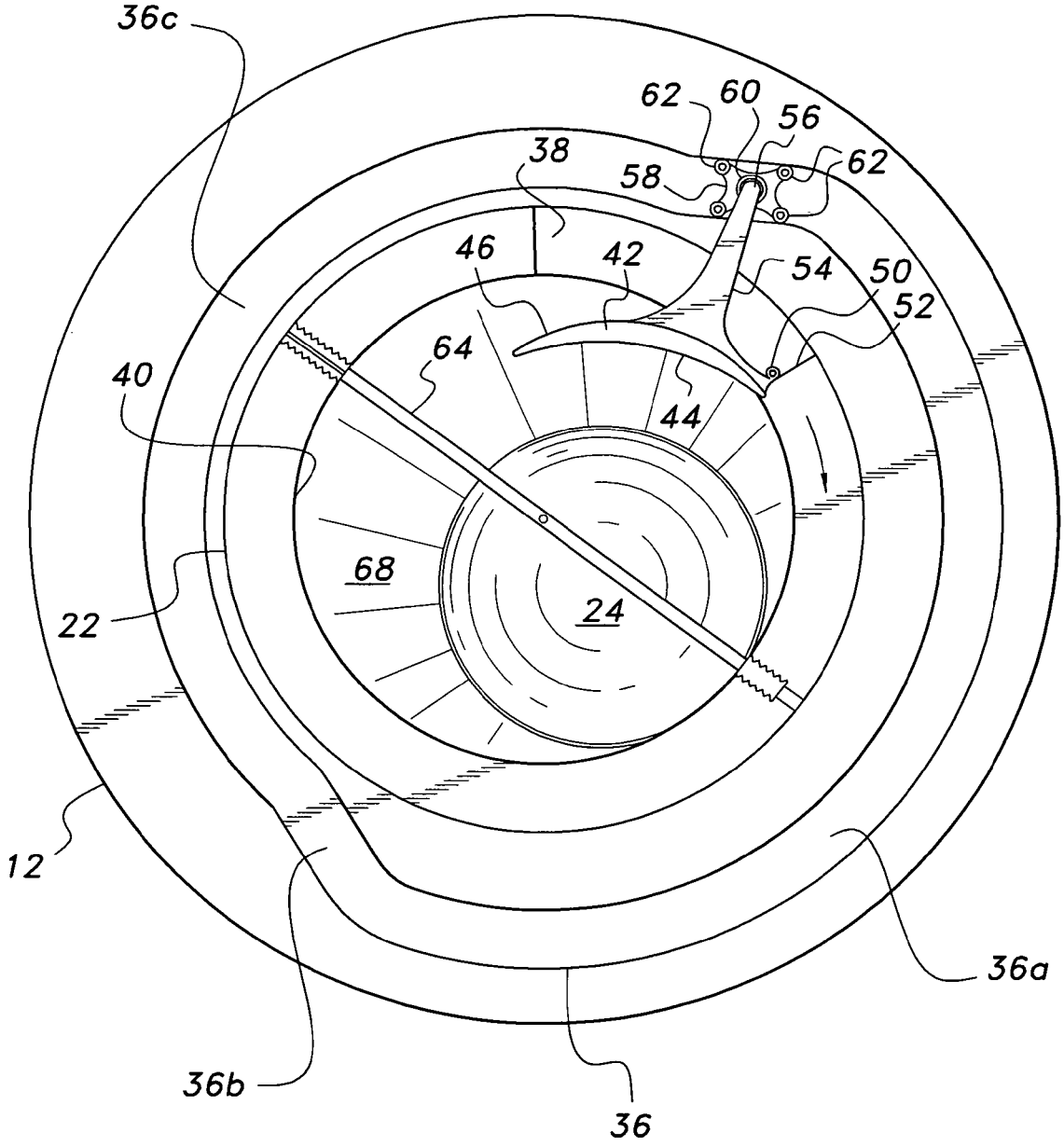

Finally, in FIG. 6H the valve actuation or cam follower mechanism 58 has started up the increasing radius ramp portion 36*d* of the cam channel 36, and the valve 44 is accordingly being drawn closed. Continued rotation of the cylinder 22 will result in the cam channel follower mechanism 58 returning to the larger radius portion 36*a* of the cam channel 36 and corresponding closure of the valve 44 to begin the compression stroke, essentially as shown in FIG. 6A.

It will be seen that the above described mechanism and its operation result in the positive actuation of the valve 44 at all times during the open and closed portions of its cycle. No springs or similar components are required to return the valve to e.g. its closed position due to a single surface actuation mechanism such as a conventional cam. The result can be much faster actuation of the valve system of the present engine, thereby allowing higher rpm and potentially greater power than is achievable with conventional engines. The continuously open valve extending through the exhaust and intake strokes serves to reduce valve actuation cycles and corresponding cyclic reciprocating loads on the valve train, thus prolonging valve life in comparison with conventional engines. These considerations, and others, are advantages possessed by the present opposed piston engine and its valve system in comparison to conventional internal combustion engines.

It is to be understood that the present invention is not limited to the embodiments described above, but encompasses any and all embodiments within the scope of the following claims.

I claim:

1. A valve system for an opposed piston engine, the engine having an engine cylinder case, a cylinder disposed within the engine cylinder case, the cylinder having an internal wall, and first and second mutually opposed pistons disposed within the cylinder, the cylinder wall and pistons defining a variable volume combustion chamber therebetween, the valve system comprising:

a poppet valve disposed within a valve port formed through the cylinder wall, the valve including a plate having a face, a back opposite the face, and a periphery;

at least one variable radius cam channel formed circumferentially within the engine cylinder case, the cam channel surrounding the cylinder;

at least one actuating arm extending generally radially outward from the back of the valve to the at least one cam channel; and a cylinder wall attachment hinge disposed upon a portion of the periphery.

2. The valve system for an opposed piston engine according to claim 1 wherein the valve plate is curved to conform closely to the cylinder wall.

3. The valve system for an opposed piston engine according to claim 1 wherein the at least one actuating arm further includes a distal end having a cam channel follower extending therefrom.

4. The valve system for an opposed piston engine according to claim 3, wherein the cam channel follower comprises at least one roller.

5. The valve system for an opposed piston engine according to claim 3, wherein the cam channel follower comprises a plurality of rollers.

6. The valve system for an opposed piston engine according to claim 3, further including a resilient connector disposed between the distal end of the actuating arm and the cam channel follower.

7. The valve system for an opposed piston engine according to claim 1, further including:

a first actuating arm extending from the back of the valve, adjacent the periphery thereof; and a second actuating arm extending from the back of the valve adjacent the periphery thereof opposite the first actuating arm, each of the actuating arms having a distal end and a cam channel follower extending therefrom, each of the cam channel followers being opposed to the other.

8. The valve system for an opposed piston engine according to claim 7, wherein each of the cam channel followers comprises at least one roller.

9. The valve system for an opposed piston engine according to claim 7, wherein each of the cam channel followers comprises a plurality of rollers.

10. The valve system for an opposed piston engine according to claim 7, further including a resilient connector disposed between the distal end of each of the actuating arms and the corresponding cam channel followers.

11. An opposed piston engine and valve system therefor, comprising in combination:

an engine case;

at least one rotary cylinder disposed within the engine case, the cylinder having an internal wall and a valve port medially disposed therethrough, the valve port having an internal valve port wall;

mutually opposed first and second pistons reciprocatingly disposed within the cylinder, the pistons and cylinder wall defining a variable volume combustion chamber therebetween;

at least one variable radius cam channel formed circumferentially within the engine case, the cam channel surrounding the at least one rotary cylinder;

a poppet valve disposed within the valve port, the valve including a plate having a face, a back opposite the face, and a periphery;

a valve attachment hinge disposed between the periphery of the valve and the valve port wall adjacent the cylinder wall, the hinge pivotally connecting the valve to the rotary cylinder;

at least one actuating arm extending generally radially outward from the back of the valve, the actuating arm having a distal end; and a cam channel follower extending from the distal end of the actuating arm, the follower being disposed within the cam channel, the follower following the cam channel and selectively opening and closing the valve in accordance with the variable radius of the cam channel.

12. The valve system for an opposed piston engine according to claim 11, wherein the valve plate is curved to conform closely to the cylinder wall.

13. The valve system for an opposed piston engine according to claim 11, wherein the cam channel follower comprises at least one roller.

14. The valve system for an opposed piston engine according to claim 11, wherein the cam channel follower comprises a plurality of rollers.

15. The valve system for an opposed piston engine according to claim 11, further including a resilient connector disposed between the distal end of the actuating arm and the cam channel follower.

16. The valve system for an opposed piston engine according to claim 11, further including:

a first actuating arm extending from the back of the valve adjacent the periphery thereof; and a second actuating arm extending from the back of the valve adjacent the sealing periphery thereof opposite the first actuating arm, each of the actuating arms having a distal end having a cam channel follower extending therefrom, each of the cam channel followers being opposed to the other.

17. The valve system for an opposed piston engine according to claim 16, wherein each of the cam channel followers comprises at least one roller.

18. The valve system for an opposed piston engine according to claim 16, wherein each of the cam channel followers comprises a plurality of rollers.

19. The valve system for an opposed piston engine according to claim 16, further including a resilient connector disposed between the distal end of each of the actuating arms and the corresponding cam channel followers.

20. The valve system for an opposed piston engine according to claim 11, further including:

an intake passage disposed through the engine case, the intake passage periodically communicating with the valve port of the rotating cylinder; and an exhaust passage disposed through the engine case, the exhaust passage being arcuately separated from the intake passage and periodically communicating with the valve port of the rotating cylinder.

* * * * *